US006907864B2

(12) United States Patent
Takemoto

(10) Patent No.: US 6,907,864 B2
(45) Date of Patent: Jun. 21, 2005

(54) FUEL INJECTION CONTROL SYSTEM FOR ENGINE

(75) Inventor: Eiji Takemoto, Obu (JP)

(73) Assignee: Denso Corporation, Kariya (JP)

( * ) Notice: Subject to any disclaimer, the term of this patent is extended or adjusted under 35 U.S.C. 154(b) by 143 days.

(21) Appl. No.: 10/643,088

(22) Filed: Aug. 19, 2003

(65) Prior Publication Data

US 2005/0022793 A1 Feb. 3, 2005

(30) Foreign Application Priority Data

Aug. 19, 2002 (JP) ..... 2002-237811

(51) Int. Cl.[7] ..... F02D 41/04

(52) U.S. Cl. ..... 123/478; 123/490; 239/533.2

(58) Field of Search ..... 123/27 R, 299, 123/300, 305, 446, 447, 472, 478, 480, 490, 467, 496, 498; 239/88, 533.2–533.9; 310/516.03, 338, 346

(56) References Cited

U.S. PATENT DOCUMENTS 4,841,936 A * 6/1989 Takahashi ..... 123/447
5,467,757 A * 11/1995 Yanagihara et al. ..... 123/305
6,400,066 B1 * 6/2002 Sumrak et al. ..... 310/346
6,617,755 B2 * 9/2003 Kawamoto ..... 310/316.03
6,691,682 B2 * 2/2004 Rueger et al. ..... 123/467
6,742,492 B2 * 6/2004 Kimura ..... 123/305
2002/0117939 A1 * 8/2002 Kawamoto ..... 310/316.03
2003/0106533 A1 * 6/2003 Crofts et al. ..... 123/446
2003/0150429 A1 * 8/2003 Rueger ..... 123/490

FOREIGN PATENT DOCUMENTS

JP 2001-241350 9/2001

* cited by examiner

*Primary Examiner*—Willis R. Wolfe, Jr.
(74) *Attorney, Agent, or Firm*—Nixon & Vanderhye P.C.

(57) ABSTRACT

An engine control unit (ECU) of an internal combustion engine performs energy changing control for changing a charging amount (an upper limit value of charging voltage, charging speed or target energy) to a piezo stack of a piezo injector in accordance with common rail pressure. During the energy changing control, the ECU contracts a command injection period as the target energy charged to the piezo stack increases so that actual injection end timing or valve closing timing of a nozzle portion is unchanged even if the target energy is changed. Meanwhile, the ECU delays command injection timing as the target energy increases so that actual injection start timing or valve opening timing of the nozzle portion is unchanged even if the target energy is changed.

7 Claims, 8 Drawing Sheets

FUEL INJECTION CONTROL SYSTEM FOR ENGINE

CROSS REFERENCE TO RELATED APPLICATION

This application is based on and incorporates herein by reference Japanese Patent Application No. 2002-237811 filed on Aug. 19, 2002.

BACKGROUND OF THE INVENTION

1. Field of the Invention

The present invention relates to a fuel injection control system for controlling quantity and timing of fuel injection into cylinders of an internal combustion engine such as a diesel engine. Specifically, the present invention relates to a fuel injection control system capable of performing energy changing control for changing a charging amount to a piezo element of a piezo injector.

2. Description of Related Art

A common rail type fuel injection system is used in a diesel engine. In the common rail type fuel injection system, a high-pressure supply pump pressure-feeds high-pressure fuel to a common rail, which is common to respective cylinders. Thus, the common rail accumulates the high-pressure fuel. The high-pressure fuel is supplied to injectors of the respective cylinders from the common rail. The injectors perform fuel injection under control of an engine control unit (ECU). Each injector has a nozzle portion for injecting the supplied high-pressure fuel through its injection hole. An opening degree of the injection hole is changed by a nozzle needle inserted inside the nozzle portion.

A back pressure chamber is formed so that the back pressure chamber faces a back end surface of the nozzle needle, for instance. The high-pressure fuel supplied to the injector is introduced into the back pressure chamber through a restriction and generates back pressure of the nozzle needle. The nozzle needle is opened or closed by changing the back pressure. The back pressure is changed by back pressure changing means. The back pressure changing means has a valve chamber between the back pressure chamber and a low-pressure passage. The back pressure changing means releases the pressure in the back pressure chamber to the low-pressure passage by moving a valve member accommodated in the valve chamber. Lately, a piezo actuator utilizing piezoelectric effect of piezoelectric ceramics and the like is used to drive the valve member.

Conventionally, in the common rail type fuel injection system having a piezo injector utilizing a piezo actuator and the like, an upper limit value of charging voltage applied to a piezo stack is changed in accordance with common rail pressure in order to control the charging amount to the piezo stack at a required minimum value. A method for changing the charging amount to the piezo stack between two levels of a large charging amount and a small charging amount is disclosed in Japanese Patent Unexamined Publication No. 2001-241350, for instance.

However, in the conventional common rail type fuel injection system, which aims to reduce heat generation by controlling the charging energy to the piezo stack at a minimum value, the charging amount to the piezo stack, or the upper limit value of the charging voltage applied to the piezo stack, changes because the charging energy to the piezo stack is changed as shown by a broken line in a part (b) of FIG. 8. A solid line in a part (a) of FIG. 8 shows a waveform of an injection command pulse "PULSE". A solid line in the part (b) of FIG. 8 shows a waveform of charging energy "Ec", or the charging voltage, to the piezo stack when the charging energy is small. The broken line in the part (b) of FIG. 8 shows the charging energy "Ec" to the piezo stack when the charging energy is large. A solid line in a part (c) of FIG. 8 shows a waveform of charging current "Cc" applied to the piezo stack when the charging energy is small. A broken line in the part (c) of FIG. 8 shows a waveform of the charging current applied to the piezo stack when the charging energy is large. A solid line in a part (d) of FIG. 8 shows an injection ratio "R" when the charging energy is small. A broken line in the part (d) of FIG. 8 shows the injection ratio "R" when the charging energy is large. A time point $t_s$ in FIG. 8 shows start timing of the injection. A time point $t_e$ in FIG. 8 shows end timing of the injection. Accordingly, a discharging waveform changes with respect to time if the charging amount is changed. The end timing $t_e$ of the injection by the piezo injector is determined in accordance with the time when the piezo stack contracts by an arbitrary degree. Therefore, the end timing of the injection is changed from the time point $t_e$ to a delayed time point $t_e'$, and an injection period changes in accordance with the change of a discharging period. As a result, actual quantity of the fuel injected into combustion chambers of the respective cylinders is deviated largely from command injection quantity.

Other than the method for changing the charging amount to the piezo stack in the two levels, there is another method for changing charging speed of the charging voltage applied to the piezo stack as shown in FIG. 9. In this case, the charging amount to the piezo stack changes in accordance with the change in the charging speed. Accordingly, the discharging waveform changes with respect to the time, and the charging waveform also changes with respect to the time. Thus, the injection end timing is changed from the time point $t_e$ to an advanced time point $t_e'$. In addition, the injection start timing of the piezo injector is changed from the time pint $t_s$ to a delayed time point $t_s'$. As a result, the actual quantity of the fuel injected into the combustion chambers of the cylinders is deviated largely from the command injection quantity. Moreover, emission performance or drivability performance of the engine is also deteriorated.

SUMMARY OF THE INVENTION

It is therefore an object of th present invention to reduce deviation of actual injection quantity from command injection quantity by correcting an injection period or injection start timing in accordance with an upper limit value of charging voltage or charging speed to a piezo stack during energy changing control for changing a charging amount to the piezo element of a piezo injector. Thus, deterioration in emission performance or drivability performance of an engine can be prevented.

According to an aspect of the present invention, charging amount changing means changes an upper limit value of charging voltage applied to a piezo element of a piezo injector in accordance with fuel pressure detected by fuel pressure detecting means. Then, a command injection period is calculated at least based on command injection quantity and the upper limit value of the charging voltage applied to the piezo element changed by charging amount changing means. The command injection quantity is set in accordance with an operating state or operating condition of an engine. Thus, change in a discharging period of the piezo element from an end time point of the command injection period to another time point at which the piezo element contracts by an arbitrary degree decreases even if energy changing control for changing the charging amount to the piezo element is performed. More specifically, even if the upper limit value of the charging voltage applied to the piezo element is changed in accordance with the fuel pressure, the change in the timing when the piezo element contacts by an arbitrary degree, closing timing of a nozzle portion or injection end timing of the piezo injector can be reduced. Thus, deviation of the actual injection quantity of the fuel injected to the engine from the command injection quantity can be reduced.

According to another aspect of the present invention, charging amount changing means changes charging speed or an upper limit value of charging voltage to a piezo element of a piezo injector in accordance with fuel pressure detected by fuel pressure detecting means. Then, a command injection period is calculated at least based on command injection quantity, which is set in accordance with an operating state or operating condition of an engine, and the charging speed or the upper limit value of the charging voltage changed by the charging amount changing means. Then, command injection timing is calculated at least based on the operating state or the operating condition of the engine and the charging speed or the upper limit value of the charging voltage changed by the charging amount changing means. Thus, even if energy changing control for changing a charging amount to the piezo element of the piezo injector is performed, change in a charging period of the piezo element from start timing of the command injection period to timing when the piezo element extends by an arbitrary degree is reduced. Meanwhile, change in a discharging period of the piezo element from end timing of the command injection period to timing when the piezo element contracts by an arbitrary degree is reduced. More specifically, even if the charging speed and the upper limit value of the charging voltage to the piezo element is changed in accordance with the fuel pressure, change in valve opening timing of a nozzle portion or injection start timing of the piezo injector can be reduced. In addition, change in the timing when the piezo element contracts by an arbitrary degree, valve closing timing of the nozzle portion or injection end timing of the piezo injector can be reduced. Thus, deterioration in emission performance or drivability performance of the engine can be prevented.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF THE REFERRED EMBODIMENT (First Embodiment)

Figure 2A:
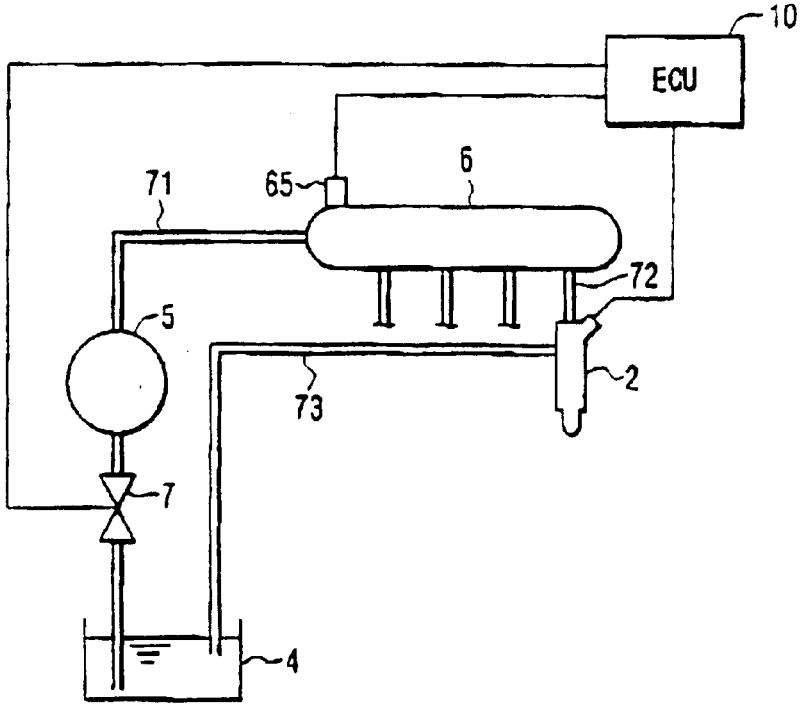
FIG. 2A is a schematic diagram showing a common rail type fuel injection system according to the first embodiment.

Referring to FIG. 2A, a common rail type fuel injection system having a piezo injector 2 according to the first embodiment is illustrated.

Figure 1:
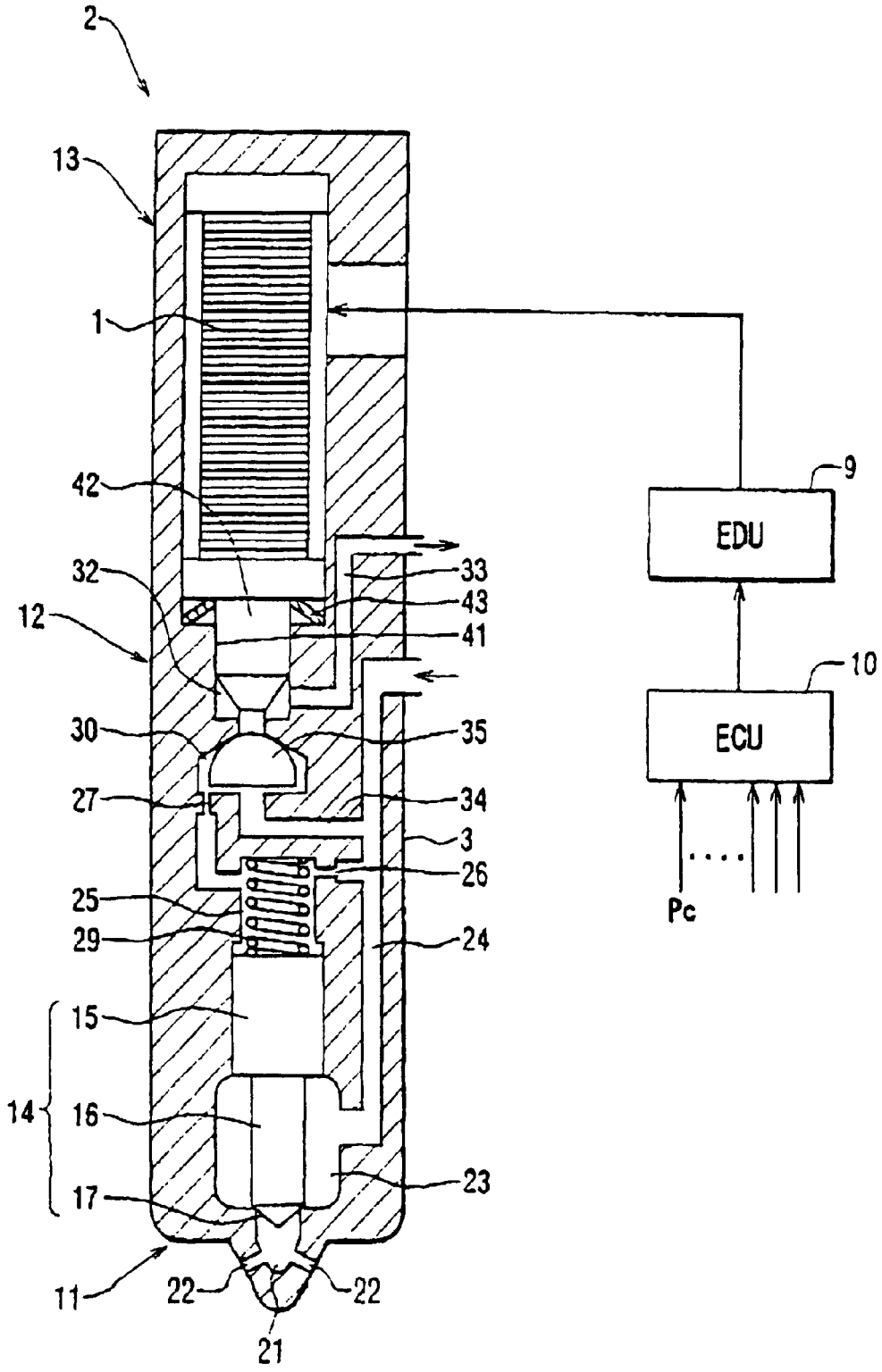
FIG. 1 is a cross-sectional view showing a piezo injector according to a first embodiment of the present invention.

A piezo element (piezo stack) 1 of the embodiment is accommodated in a rod member 3 of the piezo injector 2 as shown in FIG. 1. The piezo injector 2 is mounted on each cylinder of an internal combustion engine such as a multi-cylinder diesel engine. Thus, the piezo element 1 functions as a piezo actuator for switching between a performing state and a stopping state of fuel injection. The piezo stack 1 has a layered structure in which a multiplicity of piezo plates is stacked with electrodes in a vertical direction in FIG. 1. The piezo stack 1 extends when it is charged, and contracts when it is discharged.

The piezo injector 2 in which the piezo stack 1 is mounted is applied to a common rail type fuel injection system, for instance. The common rail type fuel injection system has the plurality of piezo injectors 2, a supply pump 5, a common rail 6, and an engine control unit (ECU) 10. The injectors 2 are mounted in respective cylinders of the engine. The supply pump 5 pressurizes the fuel drawn from a fuel tank 4 and pressure-feeds the high-pressure fuel. The common rail 6 accumulates the high-pressure fuel discharged by the supply pump 5. The ECU 10 electronically controls the supply pump 5 and the piezo stacks 1 of the plurality of piezo injectors 2.

The supply pump 5 is a high-pressure supply pump, which pressurizes the fuel drawn from the fuel tank 4 by a feed pump (a low-pressure feed pump) and discharges the high-pressure fuel into the common rail 6 from a discharge opening. A suction control valve 7 is disposed in a fuel passage leading from the fuel tank 4 to a pressurizing chamber of the supply pump 5. The suction control valve 7 regulates an opening degree of the fuel passage. The suction control valve 7 is electronically controlled based on a pump driving signal outputted by the ECU 10 to regulate suction quantity of the fuel drawn into the pressurizing chamber of the supply pump 5. Thus, the suction control valve 7 changes a common rail pressure, or an injection pressure of the fuel injected to the respective cylinders of the engine from the piezo injectors 2 of the respective cylinders.

The common rail 6 is required to continuously accumulate the fuel at a high pressure corresponding to the fuel injection pressure. Therefore, the common rail 6 is connected with the discharge opening of the supply pump 5 through a fuel supply line 71. The common rail 6 is connected with pipe joint portions of the piezo injectors 2 of the respective cylinders through fuel supply lines 72. The fuel supplied from the common rail 6 to the piezo injectors 2 is injected to the respective cylinders, and in addition, is used as hydraulic pressure fluid for controlling the piezo injectors 2.

The fuel used as the hydraulic pressure fluid is recirculated to the fuel tank 4 through low-pressure drain lines 73 from the piezo injectors 2.

Figure 2B:
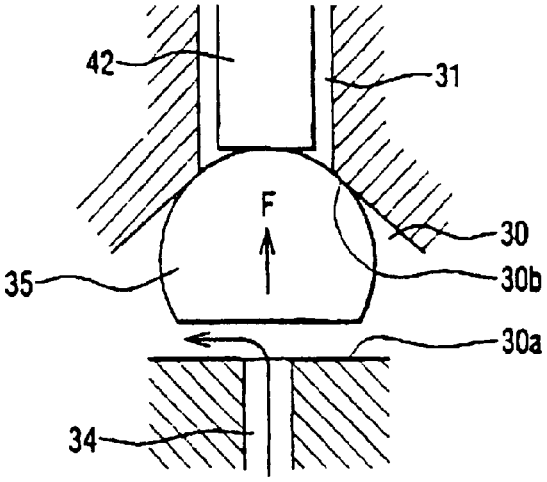
FIG. 2B is a diagram showing a substantial part of the piezo injector according to the first embodiment.

Next, structure of the piezo injector 2 of the embodiment will be explained in detail based on FIGS. 1, 2A and 2B. The plurality of piezo injectors 2 is electronically controlled based on control signals outputted from the ECU 10 through an injector driving circuit (EDU) 9. Thus, the injectors 2 inject the fuel through injection holes 22 into the respective cylinders with the injection pressure equal to the fuel pressure in the common rail 6 (the common rail pressure) at required timing and for a required period.

The piezo injector 2 has the rod member 3 providing a housing such as a nozzle body or a nozzle holder. A lower end of the piezo injector 2 in FIG. 1 penetrates a combustion chamber of each cylinder of the engine, so a tip end of the piezo injector 2 protrudes into the combustion chamber. The piezo injector 2 has a nozzle portion 11, a back pressure control portion 12 and a piezo actuator (piezo driving portion) 13 in that order from the bottom to the top in FIG. 1.

The nozzle portion 11 has a nozzle body, which is disposed at the lower end of the rod member 3 in FIG. 1, and a nozzle needle 14. A large diameter portion 15 formed at an upper end of the nozzle needle 14 in FIG. 1 is held in the nozzle body slidably. The injection holes 22 for injecting the fuel into the combustion chamber of the engine are formed at a lower end of the nozzle body in FIG. 1. The injection holes 22 penetrate a wall, which forms a sack portion 21. An annular fuel sump 23 is formed around a small diameter portion 16 of the nozzle needle 14. The fuel sump 23 invariably communicates with a high-pressure passage 24 and is invariably supplied with the high-pressure fuel from the common rail 6 through the fuel supply line 72.

The nozzle needle 14 breaks the communication between the fuel sump 23 and the sack portion 21 if a conical portion 17 formed at a tip end of the nozzle needle 14 sets on an annular seat portion of the nozzle body. Thus, the fuel injection from the injection holes 22 is prohibited. If the conical portion 17 of the nozzle needle 14 separates from the annular seat portion, the fuel sump 23 and the sack portion 21 are connected. Thus, the fuel is injected from the injection holes 22. The high-pressure fuel supplied into the fuel sump 23 from the common rail 6 through the fuel supply line 72 and the high-pressure passage 24 acts on a stepped surface between the large diameter portion 15 and the small diameter portion 16 and on a conical surface of the conical portion 17 upward in FIG. 1. Thus, the high-pressure fuel lifts the nozzle needle 14 in a valve opening direction.

The high-pressure fuel is introduced into a back pressure chamber 25 above the large diameter portion 15 of the nozzle needle 14 in FIG. 1 through the high-pressure passage 24 and an in-orifice 26. The high-pressure fuel introduced into the back pressure chamber 25 from the common rail 6 through the fuel supply line 72, the high-pressure passage 24 and the in-orifice 26 acts on an upper end surface of the large diameter portion 15 of the nozzle needle 14 downward in FIG. 1. Thus, the high-pressure fuel and a spring 29 accommodated in the back pressure chamber 25 press down the nozzle needle 14 in a valve closing direction. The spring 29 is needle biasing means for biasing the nozzle needle 14 in the valve closing direction.

The back pressure chamber 25 invariably communicates with a valve chamber 30 of the back pressure control portion 12 through an out-orifice 27. A ceiling surface of the valve chamber 30 is conically shaped as shown in FIG. 2B. The valve chamber 30 communicates with a low-pressure passage 33 through a minute hole 31 provided at the top of the ceiling surface and an annular space 32 provided around a piston 42. The low-pressure passage 33 communicates with the drain line 73. A high-pressure control passage 34 communicating with the high-pressure passage 24 is provided at a bottom surface of the valve chamber 30 so that an opening of the high-pressure control passage 34 faces the minute hole 31.

A ball valve 35 is disposed in the valve chamber 30. A bottom end of the ball valve 35 in FIG. 2B is cut horizontally. The ball valve 35 is a valve member capable of moving upward and downward in FIG. 2B. When the ball valve 35 descends, the cut surface sets on a bottom surface (a high-pressure side valve seat, a high-pressure side seat) 30*a* of the valve chamber 30 and breaks the communication between the valve chamber 30 and the high-pressure control passage 34. When the ball valve 35 ascends, the ball valve 35 sets on the ceiling surface (a low-pressure side valve seat, a low-pressure side seat) 30*b* and breaks the communication between the valve chamber 30 and the annular space 32.

Thus, if the ball valve 35 descends and breaks the communication between the valve chamber 30 and the high-pressure control passage 34, the back pressure chamber 25 communicates with the drain line 73 through the valve chamber 30, the annular space 32 and the low-pressure passage 33. As a result, the pressure in the back pressure chamber 25 decreases and the nozzle needle 14 separates from a valve seat.

On the contrary, if the ball valve 35 ascends and breaks the communication between the valve chamber 30 and the annular space 32, the communication between the back pressure chamber 25 and the annular space 32 is broken and the back pressure chamber 25 communicates only with the high-pressure passage 24 through the in-orifice 26. As a result, the back pressure of the nozzle needle 14 increases and the nozzle needle 14 sets on the valve seat.

The piezo actuator 13 presses down the ball valve 35 by the extension of the piezo stack 1. The piezo actuator 13 includes the piston 42 slidably held in a longitudinal hole 41 formed above the annular space 32 and the piezo stack 1 disposed above the piston 42 as shown in FIG. 1. The multiplicity of piezo plates is stacked in the piezo stack 1.

A large diameter portion of the piston 42 is pressed against the piezo stack 1 by a dish spring 43 disposed around a small diameter portion of the piston 42. The piston 42 moves upward or downward in FIG. 1 by an extending degree or a contracting degree of the layered piezo stack 1.

When the piezo stack 1 is contracting in a discharged state, a pressure pin integrated with the lower end of the piston 42 in FIG. 1 contacts the ball valve 35 without pressure or a minute gap is formed between the pressure pin and the ball valve 35.

When the fuel injection is started, the piezo stack 1 is charged and extends. Then, the piston 42 descends and presses down the ball valve 35. Accordingly, the pressure in the back pressure chamber 25 decreases. Thus, the nozzle needle 14 separates from the valve seat and the fuel injection is started.

When the fuel injection is stopped, first, the piezo stack 1 is discharged and contracts. Then, the piston 42 ascends and stops pressing down the ball valve 35. Since the ball valve 35 is applied with upward force (F) by the high-pressure fuel from the high-pressure control passage 34 as shown in FIG. 2B, the ball valve 35 ascends and breaks the communication between the valve chamber 30 and the annular space 32.

Accordingly, the pressure in the back pressure chamber 25 increases. As a result, the nozzle needle 14 sets on the valve seat and the fuel injection is stopped.

The high-pressure fuel in the valve chamber 30 acts on a is pressure receiving surface of the ball valve 35 having an area corresponding to that of the low-pressure side seat 30*b*. Thus, the ball valve 35 sets on the low-pressure side seat 30*b*. On the other hand, if the piezo stack 1 is charged by the EDU 9, the piezo stack 1 presses down the piston 42 and makes the ball valve 35 set on the high-pressure side seat 30*a*.

Figure 3:
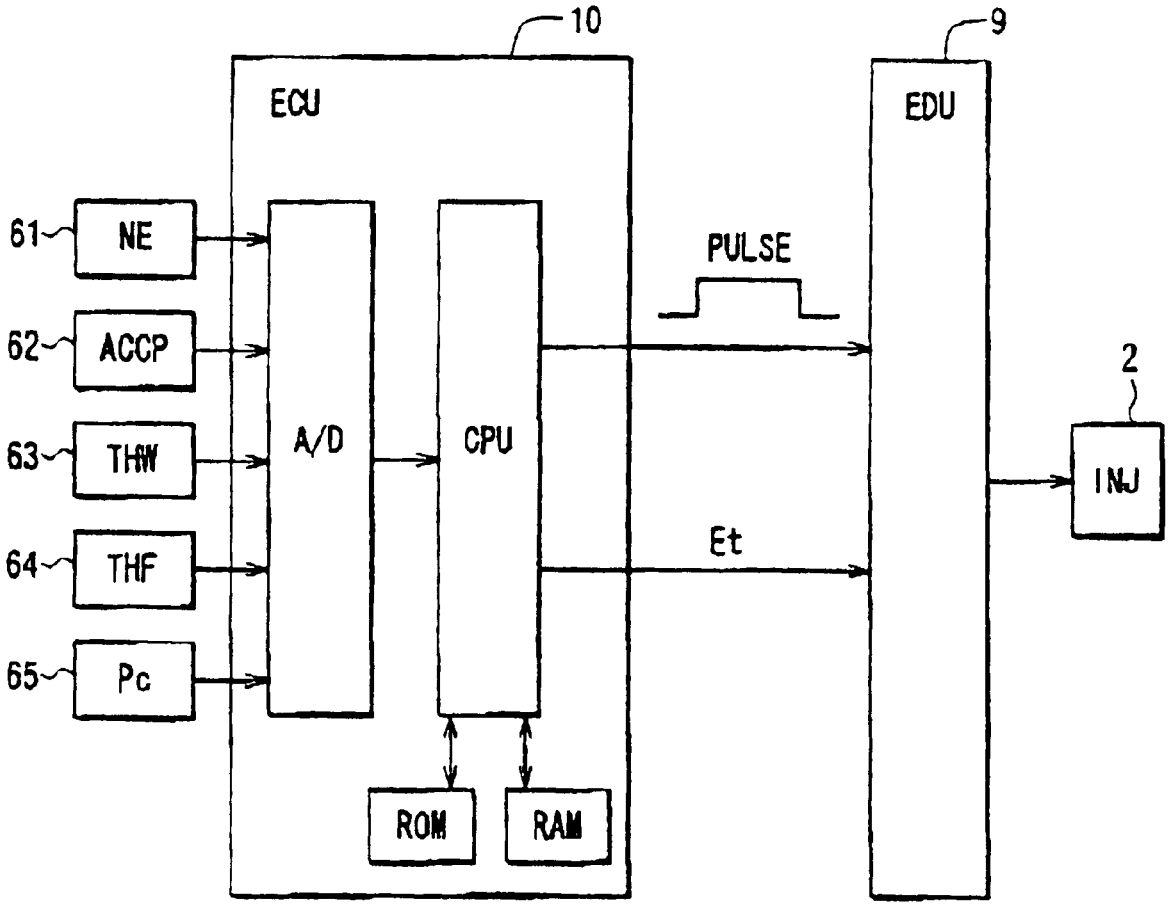
FIG. 3 is a block diagram showing an engine control unit according to the first embodiment.

The ECU 10 has a microcomputer having publicly known structure and functions of CPU for performing control processing and calculation processing, ROM for storing various programs and data, RAM, an input circuit, an output circuit, a power circuit, a pump driving circuit and the like as shown in FIG. 3. Sensor signals from various sensors are inputted to the microcomputer after the sensor signals are converted from analog signals into digital signals by an A/D converter.

The ECU 10 receives a signal of a rotational angle from a crank angle sensor 61. The crank angle sensor 61 outputs a plurality of NE signal pulses while a signal rotor rotates once, or while a crankshaft rotates once. The ECU 10 measures an engine rotation speed (NE) by measuring time intervals of the NE signal pulses. In addition, the ECU 10 receives sensor signals from an accelerator position sensor 62 for detecting a pressed degree of an accelerator pedal (an accelerator position: ACCP), a cooling water temperature sensor 63 for detecting engine cooling water temperature (THW), a fuel temperature sensor 64 for detecting temperature (THF) of fuel flowing into the fuel passage leading from the fuel tank 4 to the pressurizing chamber of the supply pump 5, a common rail pressure sensor (a fuel pressure sensor, fuel pressure detecting means) 65 for detecting the fuel pressure in the common rail 6 (common rail pressure: Pc) and the like.

The ECU 10 calculates command injection quantity (QFIN), command injection timing (TFIN) and a command injection period (Tq) based on an operating state or operating condition of the engine, and applies an injection command pulse to the EDU 9. More specifically, the ECU 10 includes basic injection quantity determining means, command injection quantity determining means, injection timing determining means, injection period determining means and injector driving means. The basic injection quantity determining means calculates an optimum basic injection quantity (Q) in accordance with the engine rotation speed NE and the accelerator position ACCP based on a characteristic map, which is made in advance by measurement through experimentation and the like. The command injection quantity determining means calculates the command injection quantity QFIN by tempering the basic injection quantity Q with an injection quantity correction value corresponding to the engine cooling water temperature THW, the fuel temperature THF and the like. The injection timing determining means calculates basic injection timing (Ts) in accordance with the engine rotation speed NE and the command injection quantity QFIN. The injection period determining means calculates a basic injection period (an injection quantity command value: Tq) in accordance with the command injection quantity QFIN and the common rail pressure Pc based on a characteristic map made in advance by measurement through experimentation and the like. The injector driving means drives the piezo stack 1 of the piezo injector 2 by applying injector driving current (an injection quantity command value, an injection command pulse) in the form of a pulse to the EDU 9. In addition, the ECU 10 may include injection timing correcting means for correcting the basic injection timing Ts into corrected injection start timing (command injection timing: TFIN) and injection period correcting means for correcting the basic injection period Tq into a corrected injection period (a command injection period: TQFIN). The injection quantity command value is an injection command pulse length, an injection command pulse width or an injection command pulse period.

The ECU 10 feedback-controls the suction control valve 7 so that the common rail pressure PC detected by the common rail pressure sensor 65 generally coincides with a target common rail pressure (PPIN) determined in accordance with the operating state or the operating condition of the engine.

The EDU 9 has common structure for driving the piezo stack 1 mounted in the piezo injector 2. The EDU 9 is constituted with a DC/DC circuit, an inductor for limiting charging current or discharging current of the piezo stack 1, a switching circuit for controlling a flow of electric charge at the piezo stack 1, or the like. The ECU 10 can carry out setting of the charge and discharge of the piezo stack 1, or can set a charging amount to the piezo stack 1 by controlling the switching circuit. The ECU 10 receives the common rail pressure PC detected by the common rail pressure sensor 65 and performs charging energy changing control (energy changing control) for changing the charging amount to the piezo stack 1 in accordance with the common rail pressure PC.

In the embodiment, as a method for changing the charging amount to the piezo stack 1 of the piezo injector 2, a method for changing the charging energy to the piezo stack 1 (upper limit voltage between both electrodes of the piezo stack 1, an upper limit value of the charging voltage applied to the piezo stack 1, a charging energy level, or target energy Et) in accordance with the common rail pressure PC is employed. Thus, the target energy Et charged to the piezo stack 1 is controlled to a minimum value while reducing heat generation.

Figure 4:
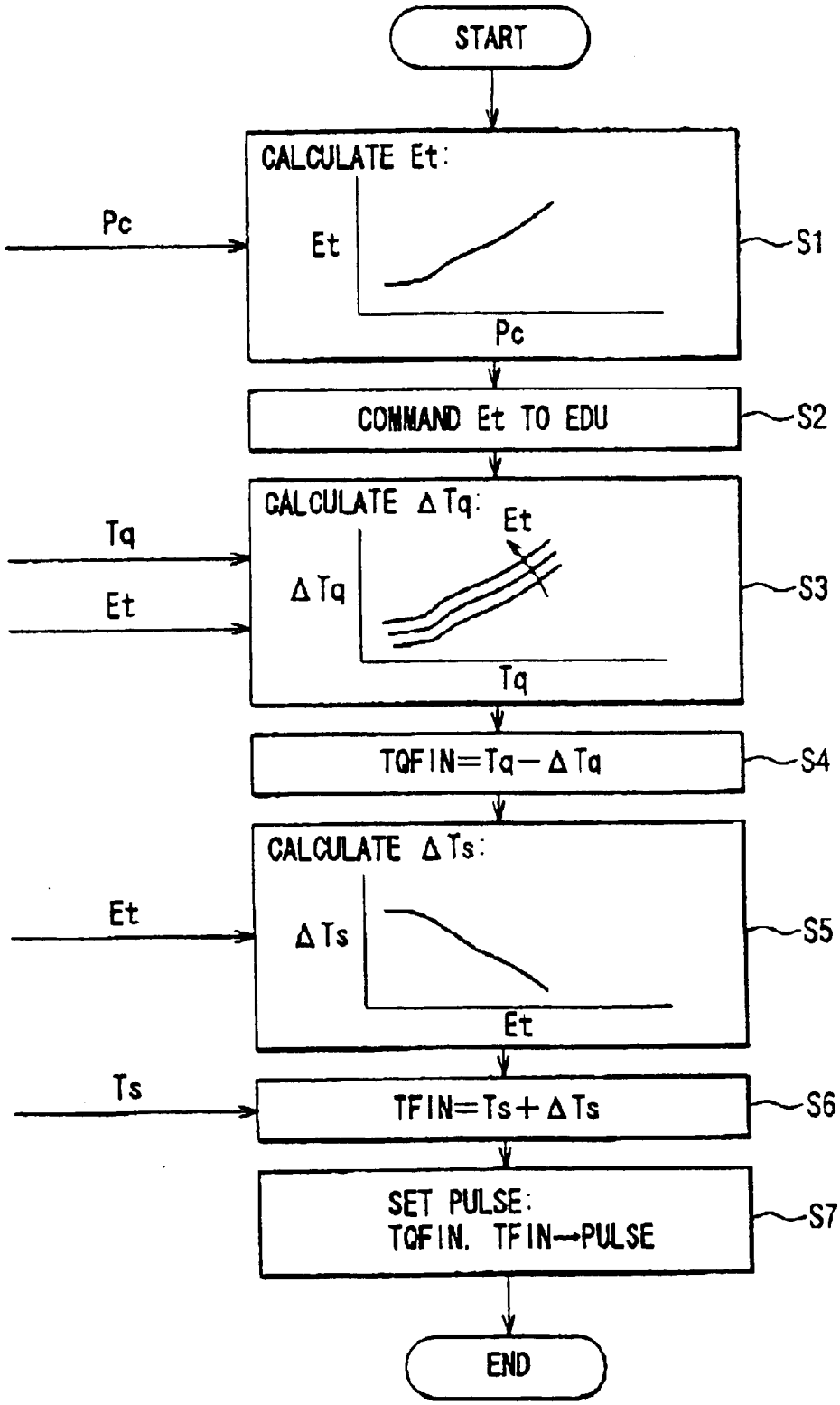
FIG. 4 is a flowchart showing a method for controlling an injection period and injection timing of the piezo injector according to the first embodiment.

Next, a method for controlling the injection period (the injection quantity) and the injection timing of the piezo injector 2 during the energy changing control for changing the charging amount to the piezo stack 1 will be explained based on a flowchart shown in FIG. 4.

If an ignition switch is switched on (IG ON), first, various sensor signals required for controlling the injection quantity and the injection timing of the piezo injector 2 such as the engine rotation speed NE, the accelerator position ACCP, the engine cooling water temperature THW, the fuel temperature THF, the common rail pressure Pc and the like are inputted. Then, the target energy Et to be charged to the piezo stack 1 is calculated based on the common rail pressure Pc by a map search (a search in a map) and the liker in Step S1 (charging amount changing means). The target energy Et to the piezo stack 1 is increased as the common rail pressure Pc increases as shown in FIG. 4.

Then, the target energy Et (an analog voltage signal, for instance) calculated in Step S1 is commanded to the EDU 9 in Step S2. Then, an injection period correction value (ΔTq) is calculated based on the target energy Et calculated in Step S1 and a basic injection period Tq by a map search and the like in Step S3 (injection period correction value determining means). The injection period correction value ΔTq is increased as the target energy Et increases as shown in FIG. 4. The basic injection period Tq corresponds to the command injection period Tq calculated in accordance with the command injection quantity QFIN and the common rail pressure Pc based on a characteristic map made in advance by measurement through experimentation and the like. Then, the corrected injection period (the command injection period) TQFIN is calculated by subtracting the injection period correction value ΔTq from the basic injection period Tq in Step S4 (injection period determining means, injection period correcting means).

Then, an injection start timing correction value (ΔTs) is calculated based on the target energy Et in Step S5 (injection timing correction value determining means). The injection start timing correction value ΔTs represents a degree to advance the injection start timing. Therefore, the injection start timing is delayed as the injection start timing correction value ΔTs decreases. The injection start timing correction value ΔTs is decreased as the target energy Et increases as shown in FIG. 4. Then, corrected injection start timing (the command injection timing: TFIN) is calculated by adding the injection start timing correction value ΔTs to the basic injection timing Ts in Step 56 (injection timing determining means, injection timing correcting means). The basic injection timing Ts is calculated from the engine rotation speed NE and the command injection quantity QFIN. Then, the injection quantity command value (the injection command pulse) based on the corrected injection period (the command injection period) TQFIN and the corrected injection start timing TFIN is outputted to the EDU 9 in Step S7. Thus, the processing is ended. Then, the processing from Step S1 is repeated.

As explained above, the common rail type fuel injection system of the present embodiment corrects the injection period and the injection start timing in accordance with the target energy Et during the energy changing control for changing the target energy Et to the piezo stack 1 of the piezo injector 2 in accordance with the common rail pressure Pc.

For instance, as the target energy Et to the piezo stack 1 increases, the command injection period is reduced so that the actual injection quantity, the actual injection end timing or the actual valve closing timing of the nozzle needle 14 is unchanged even if the target energy Et to the piezo stack 1 is changed. Thus, the changes in the injection quantity and the injection end timing are reduced. Meanwhile, as the target energy Et to the piezo stack 1 increases, the command injection timing is delayed so that the actual injection start timing or the valve opening timing of the nozzle needle 14 is unchanged even if the target energy to the piezo stack 1 is changed. Thus, the change in the actual injection start timing is reduced. As a result, the change in the actual injection period from the injection start timing to the injection end timing of the piezo injector 2 is reduced, and the change in the actual injection quantity injected into the combustion chamber of each cylinder of the engine is reduced.

Thus, even when the energy changing control is performed, the change in the charging period of the piezo stack 1 from the start timing of the charging to the time when the piezo stack 1 starts extending by an arbitrary degree is reduced. Meanwhile, the change in the discharging period of the piezo stack 1 from the end timing of the injection command pulse to the time when the piezo stack 1 starts contracting by an arbitrary degree is reduced.

As a result, even if the target energy Et to the piezo stack 1 is changed in accordance with the common rail pressure Pc, the change in the time when the piezo stack 1 starts extension (the valve opening timing of the nozzle needle 14 or the injection start timing of the piezo injector 2) can be reduced. Meanwhile, the change in the time when the piezo stack 1 starts contracting by an arbitrary degree (the valve closing timing of the nozzle needle 14 or the injection end timing of the piezo injector 2) can be reduced. Thus, the deterioration in the emission performance or the drivability performance of the engine can be prevented.

(Second Embodiment)

Figure 5:
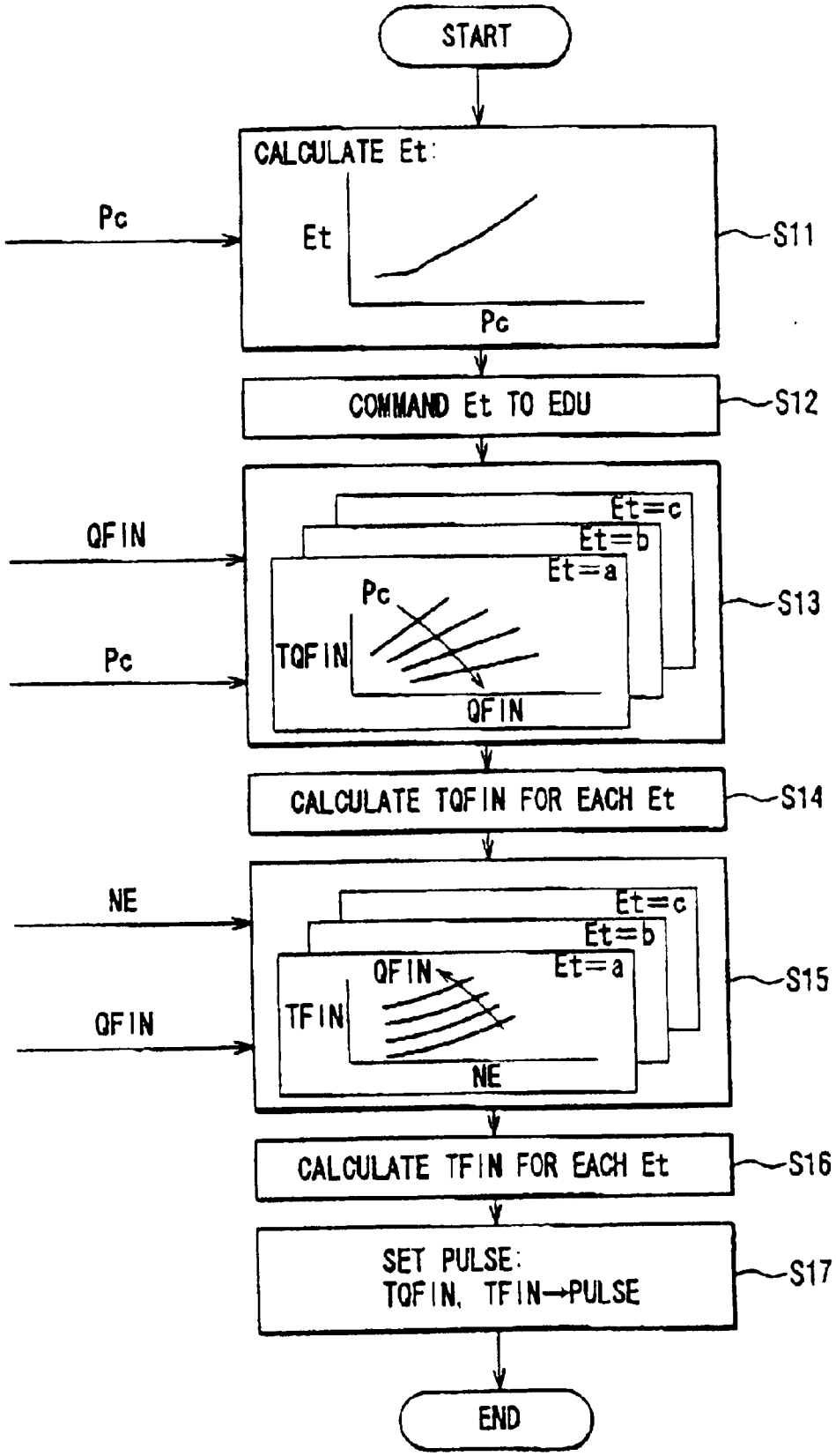
FIG. 5 is a flowchart showing a method for controlling an injection period and injection timing of a piezo injector according to a second embodiment of the present invention.

Next, a method for controlling the injection period (the injection quantity) and the injection timing of the piezo injector 2 according to the second embodiment will be explained based on a flowchart shown in FIG. 5.

If the ignition switch is switched on (IG ON), like the first embodiment, the common rail pressure Pc detected by the common rail pressure sensor 65 is inputted, and the upper limit value of the charging voltage, or the target energy Et, to the piezo stack 1 is calculated based on the common rail pressure Pc by a map search and the like in Step S11 (charging amount changing means). The target energy Et is increased as the common rail pressure Pc increases as shown in FIG. 5.

Then, the target energy Et calculated in Step S11 is commanded to the EDU 9 in Step S12. Then, the command injection period TQFIN for each target energy Et is calculated based on a characteristic map, which is made through experimentation and the like by measuring relations among the command injection quantity QFIN calculated separately, the common rail pressure Pc and the command injection period TQFIN for each target energy Et, in Step S13 and Step S14 (injection period determining means). The command injection period TQFIN is increased as the common rail pressure Pc decreases as shown in FIG. 5. The command injection period TQFIN corresponding to the target energy Et having no characteristic map is calculated by interpolation.

Then, the command injection timing TFIN for each target energy Et is calculated in Step 515 and Step S16 (injection timing determining means), based on a characteristic map made through experimentation and the like by measuring relations among the engine rotation speed NE, the command injection quantity QFIN and the command injection timing TFIN for each target energy Et. The command injection timing TFIN is delayed as the target energy Et increases. The command injection timing TFIN corresponding to the target energy Et having no characteristic map is calculated by interpolation. Then, the injection quantity command value (the injection command pulse) based on the command injection period TQFIN and the command injection timing TFIN is outputted to the EDU 9 in Step S17. Thus, the processing is ended. Then, the processing from Step S11 is repeated (Third Embodiment)

Figure 6:
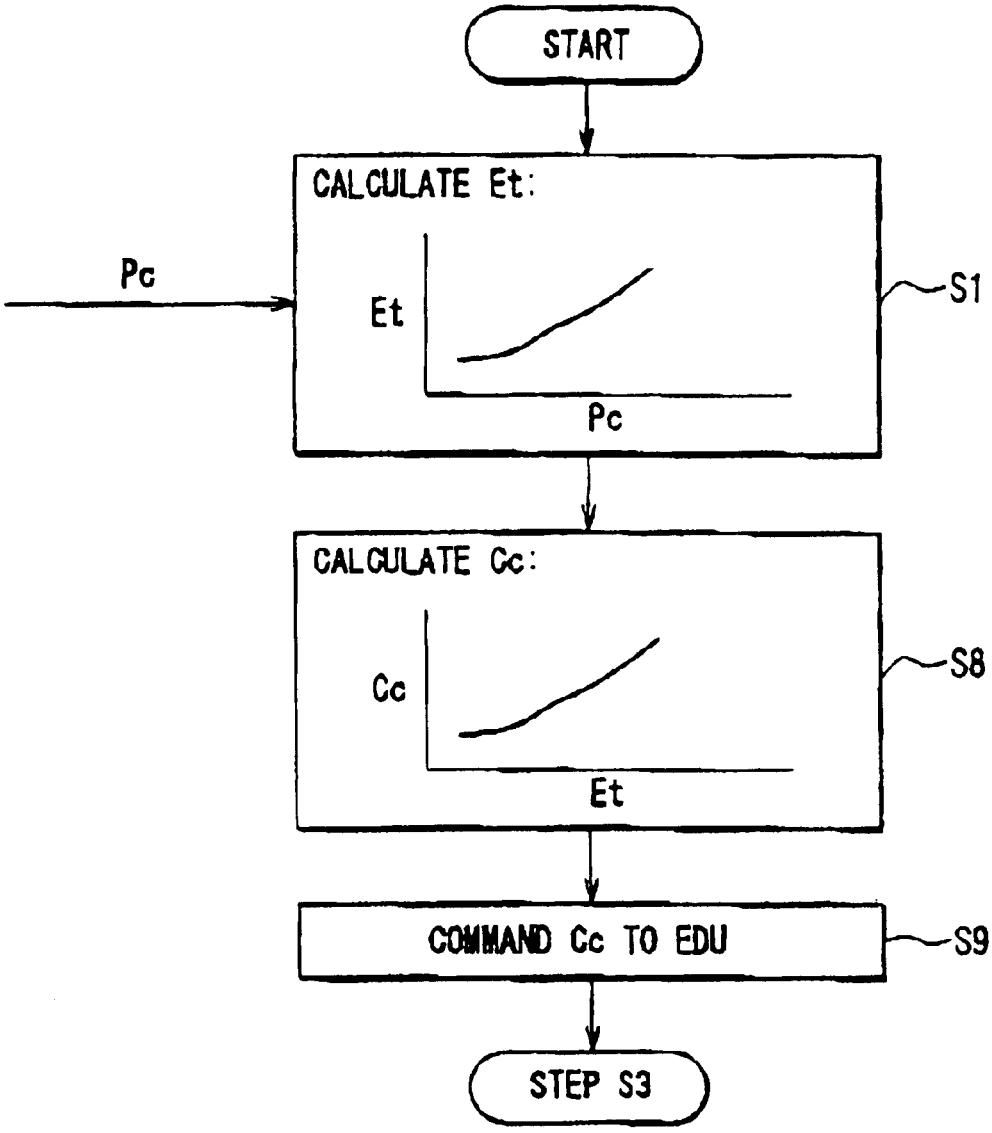
FIG. 6 is a flowchart showing a method for controlling an injection period and injection timing of a piezo injector according to a third embodiment of the present invention.

Next, a method for controlling the injection period (the injection quantity) and the injection timing of the piezo injector 2 according to the third embodiment will be explained based on a flowchart shown in FIG. 6.

In the third embodiment, as a method for changing the charging amount to the piezo stack 1, a method for changing charging speed of the charging voltage applied to the piezo stack 1 of the piezo injector 2 is employed.

First, the target energy Et to the piezo stack 1 corresponding to the common rail pressure Pc is calculated and commanded to the EDU 9 in Step S1. Then, the charging amount to the piezo stack 1 (charging speed of the charging voltage applied to the piezo stack 1), or charging current Cc to the piezo stack 1, is calculated based on the target energy Et by a map search and the like in Step SB. The charging current Cc to the piezo stack 1 is increased as the target energy Et to the piezo stack 1 increases as shown in FIG. 6.

Then, the charging current Cc is commanded to the EDU 9 in Step S9. Then, the processing proceeds to Step 53 in the flowchart shown in FIG. 4. The injection period correction value ΔTq may be calculated in consideration of the charging speed to the piezo stack 1, or the charging current Cc, in Step S3. The injection start timing correction value ΔTs may be calculated in consideration of the charging speed to the piezo stack 1, or the charging current Cc, in Step S5.

Thus, the common rail type fuel injection system according to the third embodiment calculates the corrected injection period TQFIN and the corrected injection start timing TFIN respectively corresponding to the target energy Et during the energy changing control for changing the upper limit value of the charging voltage and the charging current Cc to the piezo stack 1 in accordance with the common rail pressure PC.

As the upper limit value of the charging voltage or the charging speed to the piezo stack 1 increases, the command injection period TQFIN is decreased so that the actual injection quantity, the actual injection end timing or the actual valve closing timing of the nozzle needle 14 is unchanged even if the target energy or the charging speed to the piezo stack 1 is changed. Thus, the changes in the injection quantity and the injection end timing are reduced.

As the upper limit value of the charging voltage or the charging speed to the piezo stack 1 increases, the command injection timing TFIN is delayed so that the actual injection start timing or the actual valve opening timing of the nozzle needle 14 is unchanged even if the target energy Et or the charging speed is changed. Thus, the change in the actual injection start timing can be reduced. Thus, the change in the actual injection period of the piezo injector 2 from the injection start timing to the injection end timing can be reduced. As a result, the change in the actual injection quantity injected into the combustion chamber of each cylinder of the engine can be reduced.

Thus, even if the energy changing control for changing the upper limit voltage between the both electrodes of the piezo stack 1 (the upper limit value of the charging voltage applied to the piezo stack 1, the charging energy level) or the charging speed is performed, the change in the charging period of the piezo stack 1 from the charge start timing to the time when the piezo stack 1 extends by an arbitrarily degree is reduced. Meanwhile, the change in the discharging period of the piezo stack 1 from the end timing of the injection command pulse to the time when the piezo stack 1 contracts by an arbitrary degree is reduced.

Thus, even if the target energy Et or the charging speed to the piezo stack 1 is changed in accordance with the common rail pressure Pc, the change in the time when the piezo stack 1 starts extension (the valve opening timing of the nozzle needle 14 or the injection start timing of the piezo injector 2) can be reduced. Meanwhile, the change in the timing when the piezo stack 1 starts contracting by an arbitrary degree (the valve closing timing of the nozzle needle 14 or the injection end timing of the piezo injector 2) can be reduced. Thus, the deterioration in the emission performance or the drivability performance of the engine can be prevented.

(Fourth Embodiment)

Figure 7:
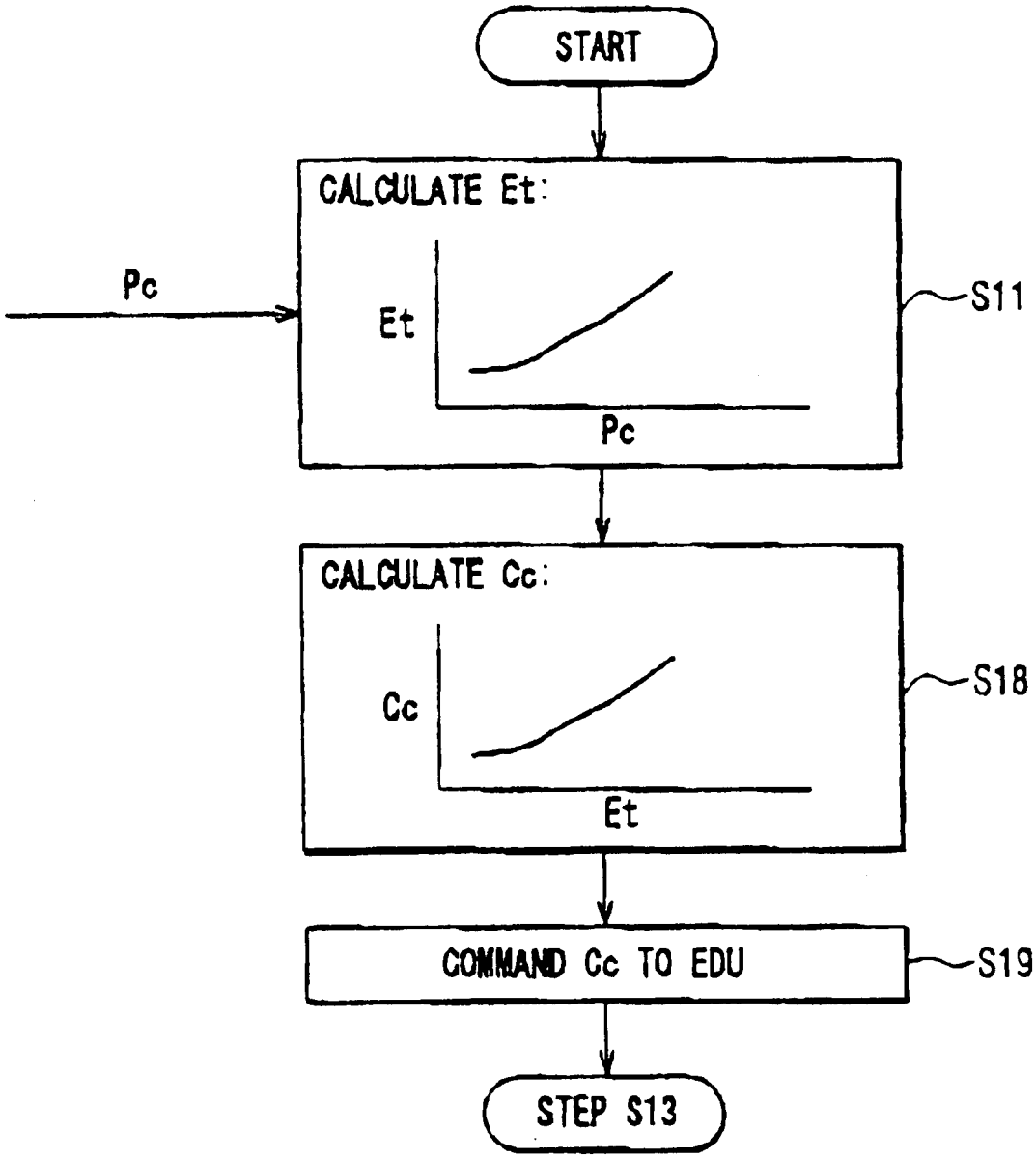
FIG. 7 is a flowchart showing a method for controlling an injection period and injection timing of a piezo injector according to a fourth embodiment of the present invention.
Figure 8:
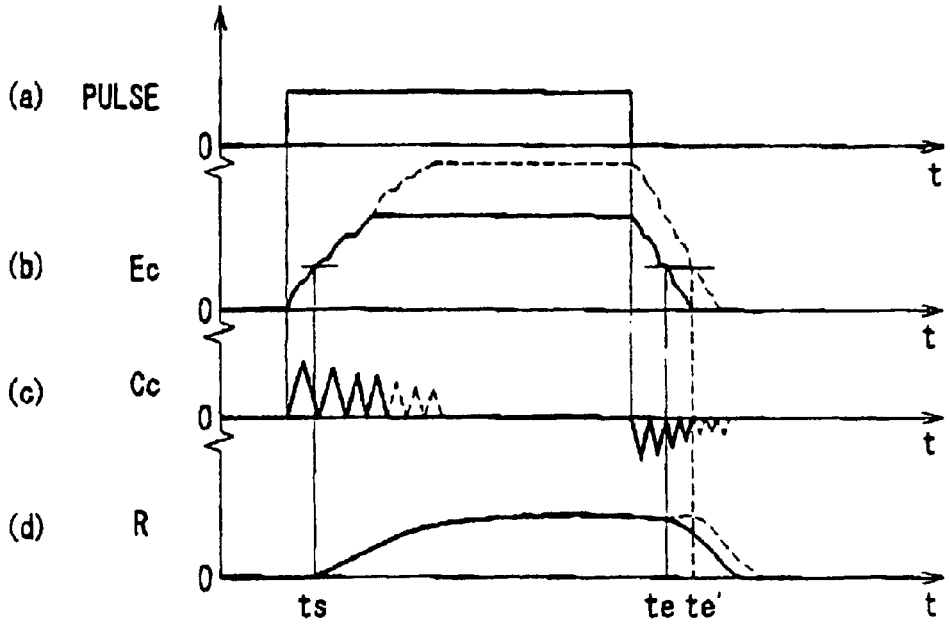
FIG. 8 RELATED ART
FIG. 8 is a timing chart showing behaviors of an injection command pulse to an EDU, target energy to a piezo stack, charging current to the piezo stack and an injection ratio in a related art.
Figure 9:
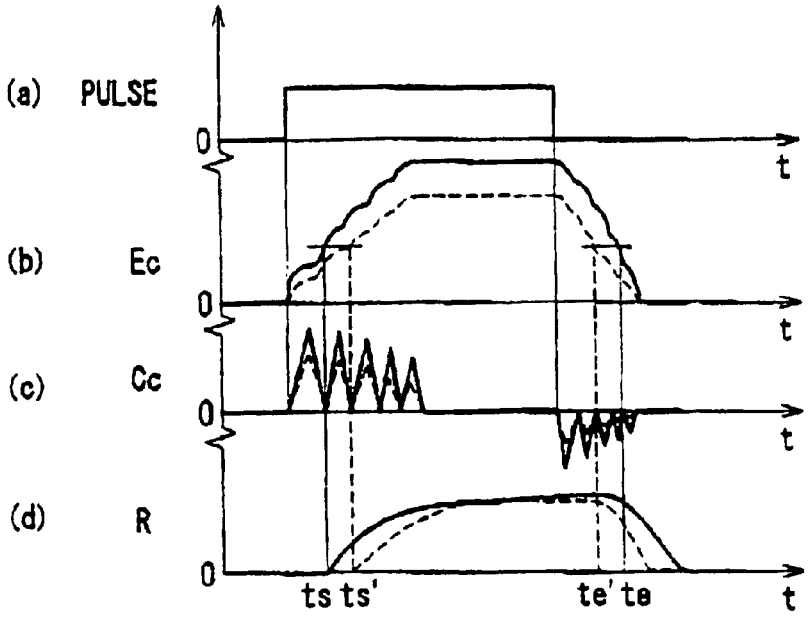
FIG. 9 RELATED ART
FIG. 9 is a timing chart showing behaviors of an injection command pulse to an EDU, target energy to a piezo stack, charging current to the piezo stack and an injection ratio in a related art.

Next, a method for controlling the injection period (the injection quantity) and the injection timing of the piezo injector 2 according to the fourth embodiment will be explained based on a flowchart shown in FIG. 7.

First, the target energy Et corresponding to the common rail pressure Pc is calculated and the target energy Et is commanded to the EDU 9 in Step S11. Then, the charging current Cc to the piezo stack 1 is calculated like the third embodiment in Step S1. Then, the charging current Cc is commanded to the EDU 9 in Step S19. Then, the processing proceeds to Step S13 in the flowchart shown in FIG. 5. The command injection period TQFIN may be calculated in consideration of the charging speed to the piezo stack 1, or the charging current Cc, in Step S13. The command injection timing TFIN may be calculated in consideration of the charging speed to the piezo stack 1, or the charging current Cc, in Step S15.

(Modifications)

In the first and second embodiments, as the method for changing the charging amount to the piezo stack 1, the method for changing the target energy Et to the piezo stack 1 in accordance with the common rail pressure Pc is employed. Only the command injection period (the injection command pulse length) TQFIN of the piezo injector 2 may be corrected without correcting the injection start timing (the command injection timing) TFIN of the piezo injector 2.

In addition, charge start timing of the piezo stack 1 may be set in accordance with the injection start timing (the command injection timing) TFIN. Moreover, a charge-holding period of the piezo stack 1 (a period for holding the piezo stack 1 in a charged state) may be set in accordance with the command injection period (the injection command pulse length) TQFIN. The injection period (the injection quantity) and the injection timing of the piezo injector 2 may be controlled based on the charge start timing and the charge-holding period of the piezo stack 1.

In the above embodiments, the common rail pressure sensor 65 is directly attached to the common rail 6 to detect the common rail pressure Pc. Alternatively, the common rail pressure sensor 65 may be attached to the fuel supply line 71, 72 or the like between a plunger chamber (the pressurizing chamber) of the supply pump 5 and a seal portion in the piezo injector 2 in order to detect the pressure of the fuel discharged form the pressurizing chamber of the supply pump 5 or the injection pressure of the fuel injected to the combustion chambers of the respective cylinders of the engine.

The present invention should not be limited to the disclosed embodiments, but may be implemented in many other ways without departing from the spirit of the invention.

What is claimed is:

1. A fuel injection control system, comprising:

a piezo injector having a nozzle portion and a piezo element, wherein the nozzle portion opens when the piezo element is charged and closes when the piezo element is discharged;

fuel pressure detecting means for detecting fuel pressure corresponding to fuel injection pressure;

charging amount changing means for changing an upper limit value of charging voltage to the piezo element in accordance with the fuel pressure detected by the fuel pressure detecting means; and injection period determining means for calculating a command injection period at least based on command injection quantity, which is set in accordance with an operating state or operating condition of an engine, and the upper limit value of the charging voltage changed by the charging amount changing means.

2. The fuel injection control system as in claim 1, wherein the injection period determining means includes injection period correcting means for contracting the command injection period as the upper limit value of the charging amount to the piezo element changed by the charging amount changing means increases so that actual injection quantity, actual injection end timing or actual valve closing timing of the nozzle portion is unchanged even if the upper limit value of the charging voltage to the piezo element is changed.

3. The fuel injection control system as in claim 1, wherein the charging amount changing means increases or decreases the charging amount to the piezo element in accordance with the fuel pressure by changing target energy charged to the piezo element in accordance with the fuel pressure detected by the fuel pressure detecting means when the charging amount changing means changes the upper limit value of the charging voltage to the piezo element.

4. A fuel injection control system, comprising:

a piezo injector having a nozzle portion and a piezo element, wherein the nozzle portion opens when the piezo element is charged and closes when the piezo element is discharged;

fuel pressure detecting means for detecting fuel pressure corresponding to fuel injection pressure;

charging amount changing means for changing charging speed and an upper limit value of charging voltage to the piezo element in accordance with the fuel pressure detected by the fuel pressure detecting means;

injection period determining means for calculating a command injection period at least based on command injection quantity, wfl±ch is set in accordance with an operating state or operating condition of an engine, and the charging speed or the upper limit value of the charging voltage changed by the charging amount changing means; and injection timing determining means for calculating command injection timing at least based on the operating state or the operating condition of the engine and the charging speed or the upper limit value of the charging voltage to the piezo element changed by the charging amount changing means.

5. The fuel injection control system as in claim 4, wherein the injection period determining means includes injection period correcting means for contracting the command injection period as the charging speed or the upper limit value of the charging voltage changed by the charging amount changing means increases so that actual injection quantity, actual injection end timing or actual valve closing timing of the nozzle portion is unchanged even if the upper limit value of the charging voltage to the piezo stack is changed.

6. The fuel injection control system as in claim 4, wherein the injection timing determining means includes injection timing correcting means for delaying the command injection timing as the charging speed or the upper limit value of the charging voltage changed by the charging amount changing means increases so that actual injection start timing or actual valve opening timing of the nozzle portion is unchanged even if the upper limit value of the charging voltage to the piezo element is changed.

7. The fuel injection control system in claim 4, wherein the charging amount changing means increases or decreases the charging amount to the piezo element in accordance with the fuel pressure by changing target energy charged to the piezo element in accordance with the fuel pressure detected by the fuel pressure detecting means when the charging amount changing means changes the upper limit value of the charging voltage to the piezo element.

* * * * *